US006131697A

United States Patent [19]

Bassett

[11] Patent Number: 6,131,697

[45] **Date of Patent: *Oct. 17, 2000**

[54] RAPPELLING ROPE CONTROLLER

[76] Inventor: Carroll C. Bassett, HC68, Box 64B, Friars Hill, W. Va. 24939

[ * ] Notice: This patent issued on a continued prosecution application filed under 37 CFR 1.53(d), and is subject to the twenty year patent term provisions of 35 U.S.C. 154(a)(2).

[21] Appl. No.: 09/342,797

[22] Filed: Jun. 29, 1999

Related U.S. Application Data

[60] Provisional application No. 60/091,340, Jul. 1, 1998.

[51] Int. Cl.[7] ..... A62B 1/14

[52] U.S. Cl. ..... 182/5; 182/192; 188/65.4

[58] Field of Search ..... 182/5, 192, 193; 188/65.4, 65.5

[56] References Cited

U.S. PATENT DOCUMENTS

| | | | |
|---|---|---|---|
| 4,702,348 | 10/1987 | Lew | 182/5 |
| 5,145,036 | 9/1992 | Omalia | 182/193 |
| 5,295,559 | 3/1994 | Nutkins | 188/65.4 |

*Primary Examiner*—Alvin Chin-Shue
*Attorney, Agent, or Firm*—Olson and Olson

[57] ABSTRACT

The rappelling rope controller of this invention includes a U-shaped rod supporting three bars of circular cross section movable along the arms of the rod, enlarged abutments on the free ends of the rod preventing removal of the bars. A rappelling rope may be reeved over the three arms in various configurations, and a person to be rappelled is connected to the closed end of the U-shaped rod.

5 Claims, 1 Drawing Sheet

RAPPELLING ROPE CONTROLLER

This application is a continuation-in-part of application Ser. No. 09/342,797, filed Jun. 29, 1999.

This application claims the benefit under 35 U.S.C. 119(e) of Provisional application Serial No. 60/091,340, filed Jul. 1, 1998.

BACKGROUND OF THE INVENTION

This invention relates to rope rappelling, and more particularly to an effective controller device for enabling rappelling with control and safety.

A variety of devices have been proposed heretofore for controlling the descent of a person by rappelling. U.S. Pat. Nos. 4,019,609; 4,678,059; and 4,723,634 are typical of the prior art. All of these have no means of compensating for weight increase or decrease with corresponding increase or decrease in friction. They provide no ability to change friction when under load, and they provide relatively low friction and consequent difficulty of control for the operator. In U.S. Pat. No. 4,019,609 the controller can become derigged inadvertently when the rope is slackened, and it depends on carabiner gates in their weakest axis. In U.S. Pat. No. 4,678,059 the elements can shift, changing friction when the rope is slackened and then re-tensioned. The controller also may easily be reeved in a dangerous manner with the rope against the gate of one or more of the carabiners rather than the carabiner spine. In U.S. Pat. No. 4,723,634 the device must be disconnected from the harness in order to be reeved, and the rope can cross the device elements diagonally, creating twists in the rope (hockling) which can lead to spontaneous rope knotting that can jam a rappel device.

SUMMARY OF THE INVENTION

In its basic concept, the rappelling rope controller of this invention includes a U-shaped base slidably supporting three bars of rounded cross section movable between the closed end of the base and abutments at the free end of the base. A rappelling rope may be reeved over and around the bars in a variety of patterns to achieve the desired rappelling action.

It is the principal objective of this invention to overcome the aforementioned limitations and disadvantages of prior rappelling rope controllers.

Another objective of this invention is the provision of a rappelling rope controller of the class described that allows a variety of reeving patterns to accommodate persons of diverse weights and various modes of rappelling.

Still another objective is to provide a rappelling rope controller that adjusts automatically the force required to control descent in direct proportion to the load.

Another objective is the provision of a rappelling rope controller of small configuration that generates greater proportional function and control than prior controllers.

A further objective is the provision of a rappelling rope controller that affords symmetrical reeving which allows easy checking for correctness of reeving and allows the controller to be used "backwards and forwards" when lowering multiple loads.

A still further objective is to provide a rappelling rope controller that cannot become detached from the rope inadvertently, is easy to securely lock off in mid rappel and will not hockle the rope.

A further objective of this invention is the provision of a rappelling rope controller of the class described that is of simplified construction for economical manufacture.

The foregoing and other objects and advantages of this invention will appear from the following detailed description, taken in connection with the accompanying drawings of a preferred embodiment.

DESCRIPTION OF THE PREFERRED EMBODIMENT

This invention was developed to provide firefighters and other emergency workers with a compact, safe, and durable personal escape descender. Early in the development, it was realized that greater friction from each bar could be realized by essentially using each bar twice. It was then quickly realized that to do this however, none of the bars could be openable.

In regular brake bar racks this would be a serious disadvantage, since a device constructed this way can only be rigged by threading the rope through the device from the end of the rope. In the case of a personal escape device this becomes a major advantage in that it cannot become accidentally de-rigged without pulling the rope through it. To avoid any chance of the rope being pulled through the device in use, a stopper knot should be tied in the end of the personal escape line.

After many different methods of rigging were experimented with, the "standard configuration" was adopted as providing the greatest number of advantages. The primary advantage being the "self compensating" nature of this configuration. This simply means that the friction generated by the device is proportional to the load the device is supporting. In other words, a heavy individual rappelling on a device has to exert about the same braking force as a light person. Other personal escape descenders do not share this feature and must be "tuned" to the user's weight and then re-tuned if that weight changes.

A secondary advantage to this configuration is its ability to be adjusted quickly and easily to any position on the rope. This is accomplished by simply spreading the bars and pulling the rope through the device. This can save critical time in establishing an anchor, especially if it is not near the exit point.

A third advantage to the "standard configuration" is that it is symmetrical. This means that it is very easy to visually check for proper configuration in both training and in actual use. A further aspect of this symmetry is that it makes no difference which end of the rope is loaded and which is used to control descent. They are interchangeable.

Figure 1:
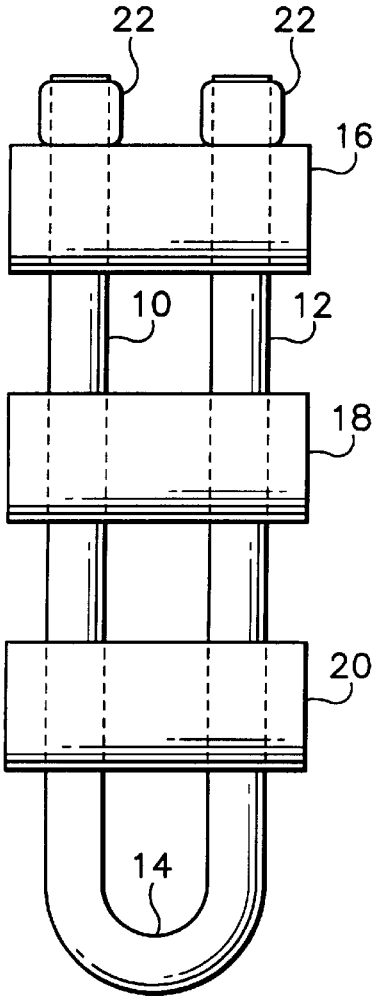
FIG. 1 is a front elevation of a rappelling rope controller embodying the features of this invention.

Referring particularly to FIG. 1 of the drawings, the controller device includes an elongated U-shaped base, illustrated in the form of a bent rod, having elongated parallel arms 10 and 12 extending from opposite ends of a closure section 14. Mounted slidably on the arms are three transverse bars in the form of rods or tubes 16, 18 and 20, preferably of circular cross section. The tubes are retained on the arms by enlarged abutments 22 on the free ends of the arms. As illustrated, the abutments are internally threaded nuts engaged on externally threaded end sections of the arms. Although the nuts may be welded or otherwise secured to the arms, the removable arrangement is preferred. Also, the top bar may be secured to the arms against movement. The movable arrangement is preferred.

Figure 2:
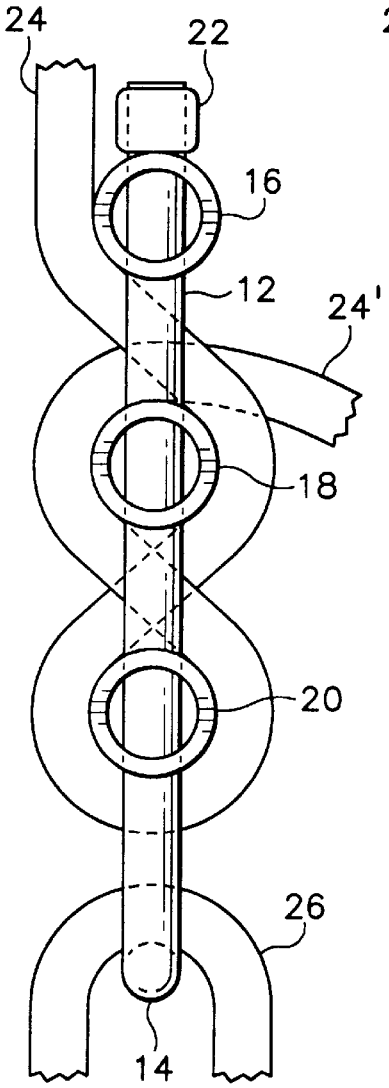
FIG. 2 is a side elevation of the controller of FIG. 1 illustrating one pattern of reeving of a rappelling rope.

FIG. 2 illustrates one arrangement of reeving a rappelling rope 24 over the three tubes. Thus, the rope extends downwardly along the left side of the upper tube 16, through the space between the upper tube and middle tube 18, around the right side of the middle tube and through the space between the middle tube 18 and bottom tube 20, thence around the bottom tube from left-to-right and upwardly through the space between the bottom tube 20 and middle tube 18, and finally around the left side of the middle tube 18 and through the space between the middle tube and upper tube 16, for extension of the controlling length 24' of rope from the device. This length 24' of the rope is grasped in the hands of a rappeller for controlling the slippage of the rope through the device to effect a rapid and safe descent.

The rappeller is secured to the rope by any suitable means, such as a snap link carabiner or other connector 26 secured to the belt or other restraint on the rappeller. The weight of the rappeller draws the tubes toward each other to squeeze the rope between them, thereby applying friction to the rope to resist its movement over the tubes. The squeezing force varies with the weight of the rappeller supported by the rope, whereby greater friction is exerted on the rope automatically as the weight of the rappeller increases.

Figure 3:
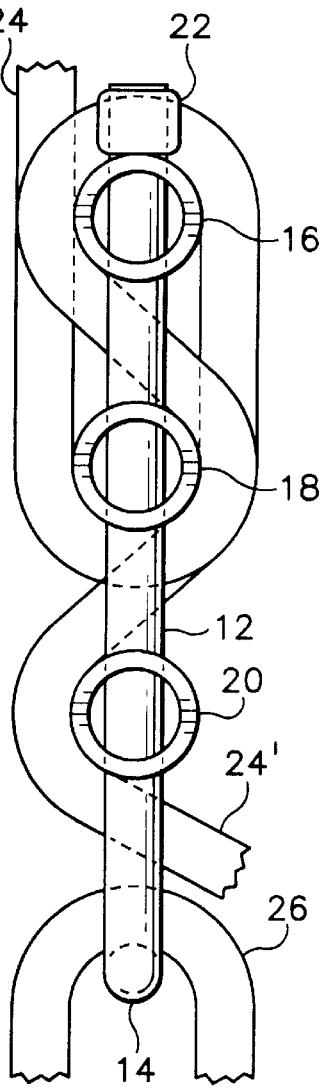
FIG. 3 is a side elevation of the controller of FIG. 1 illustrating a second pattern of reeving of a rappelling rope.

In FIG. 3 of the drawings, the second arrangement of reeving a rappelling rope 24 is shown to start the rope downward along the left sides of the upper tube 16 and middle tube 18, under the middle tube and upward around the middle tube and through the space between the middle tube and upper tube 16, thence over the top of the upper tube and downward along the right sides of the upper tube and middle tube, then through the space between the middle tube and bottom tube 20 and around the bottom tube through the space between the bottom tube and closure section 14, for grasping the controlling length 24' of rope in the hands of the rappeller for controlling the slippage of the rope through the device.

The reeving arrangement of FIG. 3 provides a greater degree of friction of the rappelling rope against the tubes 16, 18 and 20 than with the arrangement of FIG. 2. This is of advantage to heavier persons, since the heavier weight draws the tubes closer together to exert greater friction on the tope to afford better rappelling control for the heavier person.

An alternative rope reeving arrangement suggested in FIG. 3 is to extend the rope downward along the left sides of tubes 16 and 18, under the middle tube 18 and upward along the right sides of tubes 18 and 16, then leftward over the top of tube 16, downward around the tube 16 and through the space between tubes 16 and 18, then downward along the right side of the tube 18 and through the space between tubes 18 and 20, and finally under tube 20 and through the space between the tube 20 and the closure section 14, for grasping the controlling length 24', as previously described.

The controller also may be employed by an operator to effect lowering of another person or other load. For example, the connector 26 is secured to a fixed anchor, the rope 24 is reeved over a pulley or other fixed support and the person or load is attached to the depending, free end of the rope and a length of rope extending vertically downward from the pulley is reeved through the controller and the laterally extending length of rope 24' is paid out under the control of the operator.

In all cases the procedure of reeving the rappelling rope over and through the spaces between the tubes 16, 18 and 20 is facilitated by the free sliding movement of the tubes along the arms 10 and 12. Adjustment of the controller to a desired position along the length of a rappelling rope may be facilitated and accelerated by pulling downward on the bottom tube 20 toward the closure section 14, to enlarge the spaces between the tubes.

It will be apparent to those skilled in the art that various changes may be made in the size, shape, type, number and arrangement of components described hereinbefore. For example, the bars 16, 18 and 20 may be of oval or other rounded shape, the top bar 16 may be secured to the arms 10 and 12 or abutments 22 against downward movement along the arms, and the closure section may be formed as a separate element secured to the long ends of the arms. Other rope reeving configurations may be used which employ all of the three bars to apply friction to the rappelling rope, all to provide the rappelling person with the control required to effect a safe descent. One or more additional bars may be utilized, if desired, to work with a wide range of ropes. These and other changes may be made, as desired, without departing from the spirit of this invention and the scope of the appended claims.

I claim:

1. A rappelling rope controller, comprising:

a) an elongated U-shaped base member having a pair of parallel arms spaced apart by a closure end opposite spaced free ends, b) at least three bars of rounded cross section each having a pair of spaced apart, peripherally closed openings confining therein the spaced apart arms of the base member, and c) stop means on the free ends of the arms for preventing removal of the bars from said arms, d) a first of said bars being located adjacent the stop means on the arms, e) a second of said bars being located adjacent said closure end, f) the at least one third bar being located between said first and second bars, g) said second bar being slidable freely along said base member arms between said closure end and abutment with said at least one third bar, and h) said at least one third bar being slidable freely along said base member arms between abutment with said first bar and abutment with said second bar.

2. The controller of claim 1 wherein the closure end of the base member provides a connecting support for a load to be rappelled.

3. The controller of claim 1 wherein all said bars are movable along said base member arms and said first bar is slidable freely along said base member arms between abutment with said stop mean and abutment with said at least one third bar.

4. The controller of claim 1 wherein the bars are circular in cross section.

5. The controller of claim 1 wherein the means on the free ends of the arms are nuts secured removably to said free ends.

* * * * *